US006152069A

United States Patent [19]

Li et al.

[11] Patent Number: 6,152,069

[45] **Date of Patent: *Nov. 28, 2000**

[54] MULTI-CHAMBER SHORT DWELL COATER

[75] Inventors: Alfred C. Li, Naperville; James R. Burns, South Beloit, both of Ill.; Gerald R. Garde, Beloit; Rex A. Becker, Janesville, both of Wis.

[73] Assignee: Beloit Technologies, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/056,079

[22] Filed: Apr. 6, 1998

[51] Int. Cl.[7] ..... B05C 3/02

[52] U.S. Cl. ..... 118/413; 118/419; 118/410; 118/411

[58] Field of Search ..... 118/413, 410, 118/419, 411

[56] References Cited

U.S. PATENT DOCUMENTS

| | | | |
|---|---|---|---|
| 4,405,661 | 9/1983 | Alhuid | 118/410 |
| 4,834,018 | 5/1989 | Sollinger et al. . | |
| 4,839,201 | 6/1989 | Rantanen et al. | 118/410 |
| 4,873,939 | 10/1989 | Eskelinen . | |
| 4,903,632 | 2/1990 | Sollinger . | |
| 4,930,437 | 6/1990 | Eckhard . | |
| 4,945,855 | 8/1990 | Eklund et al. . | |
| 4,964,364 | 10/1990 | Kärnä et al. . | |
| 5,173,120 | 12/1992 | Suzumura et al. . | |
| 5,824,369 | 10/1998 | Li et al. . | |

*Primary Examiner*—Brenda A. Lamb
*Attorney, Agent, or Firm*—Lathrop & Clark LLP

[57] ABSTRACT

A coater head for contacting a liquid coating material with a traveling web of paper or fabric. The coater head includes at least two chambers and an extended outflow bubble to increase the zone of contact between coating liquid and the traveling web. Improved, coating quality also results from controlled flow characteristics through the coater head having a feed zone length-to-depth ratio of four or more.

5 Claims, 3 Drawing Sheets

MULTI-CHAMBER SHORT DWELL COATER

BACKGROUND AND FIELD OF THE INVENTION

This invention relates to an apparatus for coating a traveling web of paper, which is frequently, but not always, done on a papermaking machine. More particularly, this invention relates to an apparatus for coating a traveling web utilizing a multi-chamber short dwell coater having a flow separator plate defining at least one orifice through which a coating liquid can flow during the coating process to reduce localized cross-machine pressure variances, reduce overall coating liquid pressure on the web, and improve coating quality regardless of web travel speed.

A multi-chamber short dwell coater in accordance with the present invention applies coating on a web at high machine speed, and has a metering zone separated from an application zone and an outflow zone. The metering zone is separated from the application zone by a flow separator to reduce propagation of flow instabilities into the metering zone. The outflow zone is extended by a baffle plate to increase the size of the contact zone and reduce air bubble entrainment in the coating. The result is improved uniformity and runnability of coatings at high machine speed.

Slot coaters have been used in low speed coating of photographic film and other coating processes. A major limitation to increasing the application speed of slot coaters is the inability to match the coating fluid velocity with that of the moving web. In addition, slot coaters require a vacuum to stabilize the contact line between the coating material and the web which limits the speed at which coating can be applied.

Coating apparatus for applying a liquid coating onto a traveling web having a partitioned coating chamber are disclosed in Suzumura et al., U.S. Pat. No. 5,173,120, having, for example, chambers A and B separated by a partition plate 10. A pre-metering blade 11 prevents air bubble entrainment and isolates areas of fluid instability created in an outflow region from the metering zone. A potential problem associated with this coater design is increased frequency of paper breaks resulting from the use of multiple blades coming in contact with the web.

The width of chamber B in the machine direction is such that the coating liquid can circulate within this chamber to form undesirable vortices. The vortices are unavoidable with such a design because chamber B must be relatively wide to accommodate the converging and flexible pre-metering blade 11 attached to the upper distal end of the separator partition 10 that extends downstream to converge with the web 3 as it passes over the backing roll 2. Further, coating liquid flowing over the top of the relatively short dam plate 8 can be entrained with air traveling on the surface of the paper web at the converging gap between the blade 11 and the traveling web. Entrained air diminishes coating quality and increases streaking problems.

The pre-metering blade 11 is described as being resilient (col. 3, line 28), which can become unstable during operation and adversely affect the pressure of the coating liquid as it is supplied to the surface of the traveling web. Pressure variations such as these result in non-uniformity and lower coating quality. With such pressure variations, the blade 11 can be misaligned or even "chatter" during operation and eventually its purpose is defeated.

Further, the full force exerted by the coating liquid against the web in the Suzumura et al. coater is produced by the liquid pressure over the machine-direction length of the pond at the top of chamber A and chamber B. Force over the converging blade 11 is a function of the integral of the pressure profile over the effective length of the surface of the converging blade. The integration produces a relatively large force value. Significantly, the effective blade length in the machine-direction is relatively long, so the integration produces a relatively large force value regardless of the pressure of the coating liquid. This high force can result in the web being impregnated with coating liquid as opposed to applying coating liquid to the surface for a better finished paper quality.

Thus, it is desirable to have a coater that provides uniform liquid coating pressure with low forces and minimized air entrainment to provide high quality coatings at high machine speeds.

SUMMARY OF THE INVENTION

Apparatus for coating a traveling web of paper or fabric with a film coating material in accordance with present invention, includes a coater head with an inlet; a flow separator having a proximate end fixed to the coater head and a distal end spaced apart from the traveling web, and the least partially defining with the coater head a pond; a metering blade having a proximate end fixed to the coater head and a distal end, to least partially define with the flow separator a feed zone in fluid communication with the pond; and an outflow baffle having a proximate end fixed to the coater head and a distal end extending outwardly and upstream from the coater head to define with the traveling web an outflow zone, wherein at least a portion of the outflow zone and the pond define an application zone.

The pond serves as a reservoir for the initial coating of the sheet material and it dissipates the additional energy input to the system from the traveling web as the machine speed increases. Any flow instabilities in the pond or overflow zone will be separated from the flow variations in the metering zone as a result of using the flow separator.

With an arrangement of two reservoirs separated by a flow separator, coating is driven by the traveling web toward the metering blade and excess coating liquid is metered and then flows through perforations in the flow separator. A perforated flow separator as used in the present invention acts as a rigid boundary wall to provide a desired flow pattern such that: 1) energy is uniformly distributed in a cross-machine direction; 2) flow variations are minimized; and 3) no global regions have a negative pressure. This effectively separates the application and outflow zones from the metering zone. The height of the flow separator is sufficient to reduce the boundary layer thickness of coating material on the web and momentum transfer to the metering element for more uniform flow conditions at the metering element.

Yet another advantage of the present invention is that the outflow zone is augmented with an extended baffle that has a stabilizing effect on the contact line between coating liquid and the web in the outflow region to avoid or reduce the necessity of applying a vacuum to stabilize the contact line. The extended baffle results in better uniformity of coating and control of the contact line location between the web and coating liquid.

An alternate embodiment of the invention may include a flow separator that is adjustable relative to the web surface to adjust the boundary layer thickness and momentum transfer of the liquid coating material that reaches the metering element. The flow separator may be adjustable relative to the metering element to vary the flow dynamics as machine speed or coating Theological properties vary.

Another multi-chamber short dwell coater in accordance with the present invention overcomes the disadvantages known in prior art coaters by including a relatively high feed zone length to depth ratio to alleviate the effects of vortices forming in the feed zone at high web travel speeds, particularly when applying coating fluids on light weight and other grades of paper at operation speeds of up to 4500 feet per minute or higher. Diminished vortex formation is due to the relatively narrow feed and metering zones in the machine direction. The ratio of a zone's length to depth is referred to as the aspect ratio.

Further, the force of the coating liquid against the web in the present invention is a function of the integration of the pressure profile in the application zone. Consequently, there may be a pressure spike in the neighborhood of the separator plate and the metering blade, but the total force of the coating liquid acting on the web is still lower than in prior art coaters. This results in a lower total force of the coating liquid against the paper so the platelets in the coating material are not forced into the web fibers, but rather are deposited and remain on the surface of the traveling web. Surface coating is preferable for printability issues.

With a lower liquid pressure acting on the web, improved runnability can be realized which results in a higher quality coated web produced at a higher machine speed.

DETAILED DESCRIPTION OF THE DRAWINGS

Figure 1:
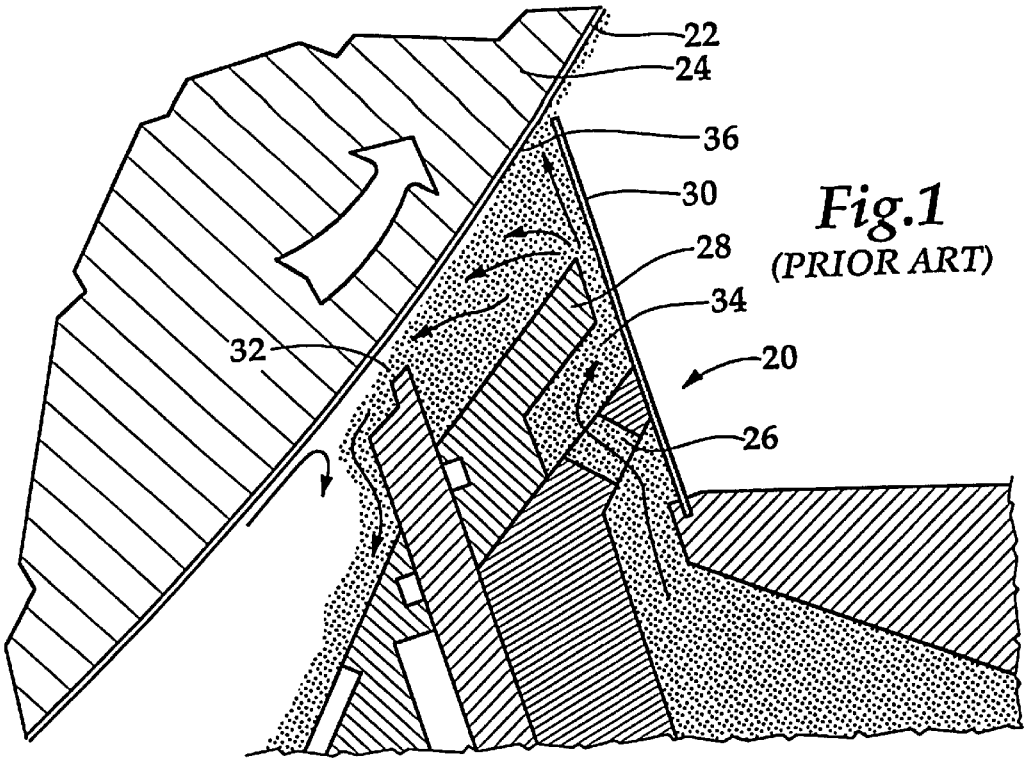
Fig.1 (PRIOR ART)
FIG. 1 is a partial cross-section of a prior art coater head applying a coating liquid to a traveling web passing over a backing roll.

FIG. 1 illustrates a prior art coater head 20 positioned adjacent a traveling web 22 supported by a backing roll 24. The backing roll 24 is rotating in a counter-clockwise direction and the traveling web 22 is moving in a generally upward direction and may be paper or fabric within the scope of this invention. This prior art coater head 20 includes an inlet 26, a baffle plate 28, a metering blade 30, and an outlet 32. Liquid coating material 34 enters the coater head 20 through the inlet 26 and is redirected by baffle plate 28 toward the metering blade 30 where the liquid coating material 34 flows into contact with the traveling web 22. After contacting the traveling web 22, the liquid coating material 34 flows upstream toward the outlet 32 with a substantially diminished flow velocity and momentum so that the surface of the liquid coating material 34 falls away from the traveling web 22.

Where the liquid coating material 34, the traveling web 22, and air coincide is known as a triple point 36. The closer the triple point 36 is to the metering blade 30, the greater the amount of entrained air in the coating applied to the traveling web 22 resulting in a lower quality coating. Further, energy from the traveling web 22 is transferred to the liquid coating material 34 beginning at the triple point 36. As a result, the flow field of the liquid coating material 34 can vary which can also adversely affect coating quality.

Figure 2:
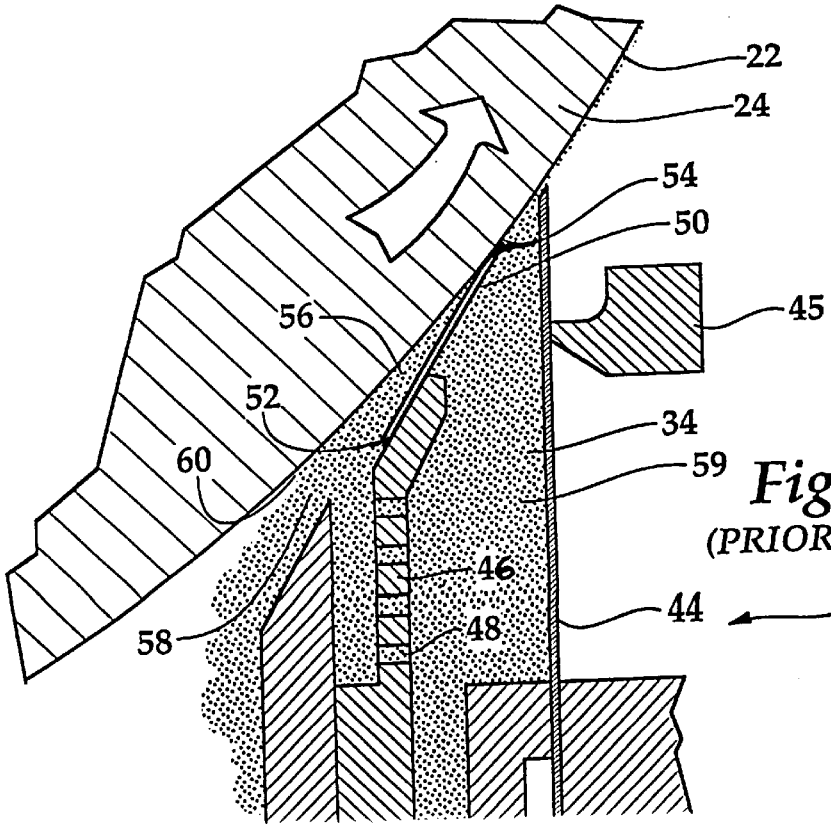
Fig.2 (PRIOR ART)
FIG. 2 is a partial cross-section of another prior coater head having multiple chambers and a pre-metering blade.

An attempt to overcome the shortcomings of the prior coater head 20 of FIG. 1 is illustrated in FIG. 2. This second prior art coater head 40 includes an inlet 42, a metering blade 44, supported by a biasing means 45, a separator wall 46 defining a number of orifices 48, a pre-metering blade 50 having a proximate end 52 fixed to the separator wall 46 and a distal end 54 extending outward and downstream from the separator wall 46 to define a converging zone 56 adjacent to the traveling web 22. This coater head 40 also includes an outlet 58 through which overflow liquid coating material 34 flows to be recycled.

With the coater head 40 design, the triple point 60 is spaced farther away from the metering blade 44 to result in less entrained air in the coating. Further, some pressure on the paper web 22 exerted by the liquid coating material 34 is alleviated due to the fact that liquid coating material 34 can flow through the orifices 48 as pressure in the feed zone 59 increases. Although this design alleviates some of the problems associated with the prior coater head 20 illustrated in FIG. 1, there are still considerable problems with development of vortices in the feed zone 59 which adversely affects the feed rate of liquid coating material 34 to the metering blade 44 when the paper web 22 is traveling at high speeds. Further, the additional force exerted by the liquid coating material 34 in the converging zone 56 can rise to excessive levels and cause the coating material 34 to penetrate the paper web undesirably, cause web 22 breakage, and requires the pre-metering blade 50 to be quite close to the traveling web 22 which can result in web breakage.

Figure 3A:
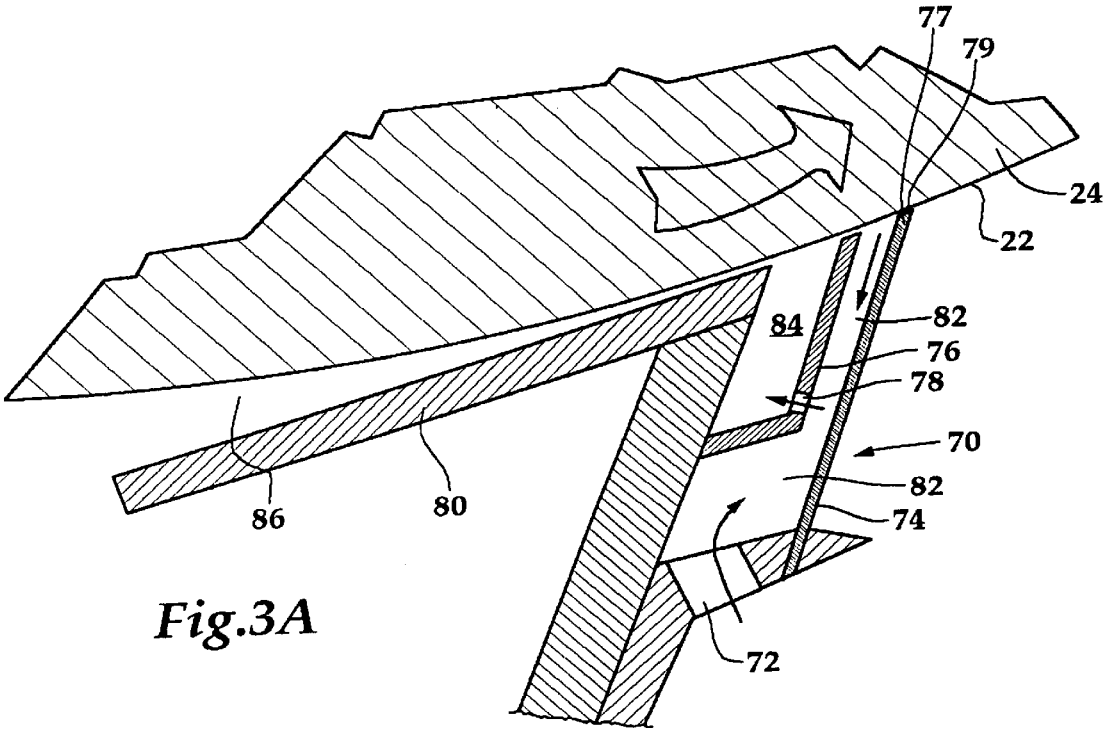
FIG. 3A is a partial cross-section view of a coater head in accordance with present invention having a single row of slots in a separator blade.
Figure 4A:
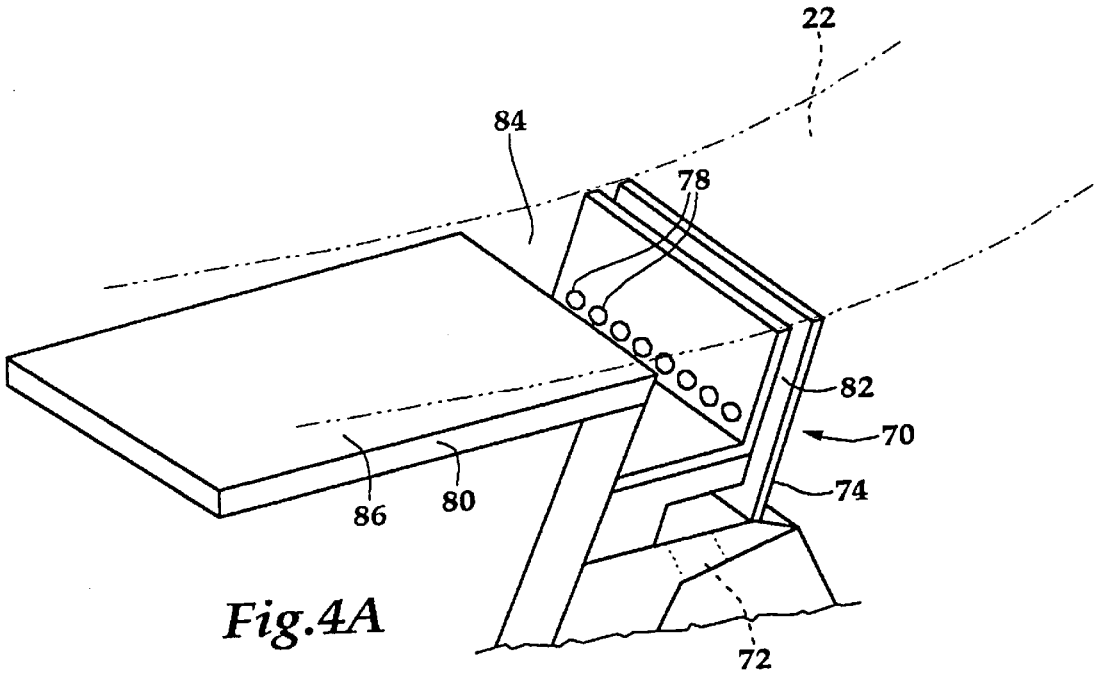
FIG. 4A is a partial perspective view of the coater head illustrated in FIG. 3A.

FIGS. 3A and 4A illustrate a coater head 70 in accordance with the present invention which includes an inlet 72, a metering blade 74, a separator plate 76 defining a row of holes/slots 78 in the cross-machine direction, and an outflow baffle 80 extending upstream from the coater head. The metering blade 74 and the separator plate 76 define therebetween a recirculation/feed zone 82 into which liquid coating material 34 flows from the inlet 72. The separator plate 76 and coater head 70 define a pond 84 which receives liquid coating material 34 from the slot 78 or from the feed/recirculation zone 82 or from over the top of the separator plate 76. The extended outflow baffle 80 defines an outflow zone 88 with the traveling web 22. The separator plate 76 has a distal end 77 that defines with the web 22, a boundary layer zone 79 that controls the amount of coating material 34 flowing on the web surface toward the metering blade 74 to aid in applying a uniform coating layer at high machine speeds. Further, the separator plate 76 is positioned to avoid the formation of a converging pre-metering zone as in coater head 40 (FIG. 2) that results in higher liquid forces on the web 22.

With this arrangement, an extended zone of contact between the coating material 34 and the traveling web 22 is defined by the outflow zone 88, the pond 84, and the feed/recirculation zone 82. Due to the extended length of the contact zone, a triple point 90 (where the atmosphere, liquid coating material 34, and the traveling web 22 merge) is positioned substantially away from the metering blade 74 to vastly reduce the amount of entrained air that reaches the metering blade without the need of a vacuum in the coater. Further, the force applied by the liquid coating material 34 against the traveling web 22 is substantially reduced because the only location of high liquid pressure is along the distal end 77 of the separator plate 76 which, due to its small size, results in a small applied force.

The length (vertical dimension as illustrated) of the feed/recirculation zone 82 is defined by the cantilevered portion of the metering blade 74. The depth of the feed/recirculation zone 82 (horizontal dimension as illustrated) is defined by the spacing between the metering plate 74 and the separator 76. With the present invention, using a feed zone length substantially longer than feed zone depth provides a vast reduction in the formation of flow vortices in the feed zone 82. With greater control over the direction and flow properties of the liquid coating material 34, greatly enhanced coating quality results even at high machine speeds. Preferably, the feed zone length to depth ratio is equal to four or more to alleviate the above-described deleterious vortices. This dimensional ratio varies over time with metering blade wear, but the benefits of this invention will be realized when the average ratio over time is about four. The ideal spacing for sizing of the feed/recirculation zone 82 depends a great deal on the properties of the liquid coating material 34 and machine speed. Nonetheless, optimizing the feed/recirculation zone dimensions while maintaining the four-to-one ratio of length to depth will result vastly improved coating properties. Further, the same or similar aspect ration can be applied to the pond 84 to reduce vortices there.

Figure 3B:
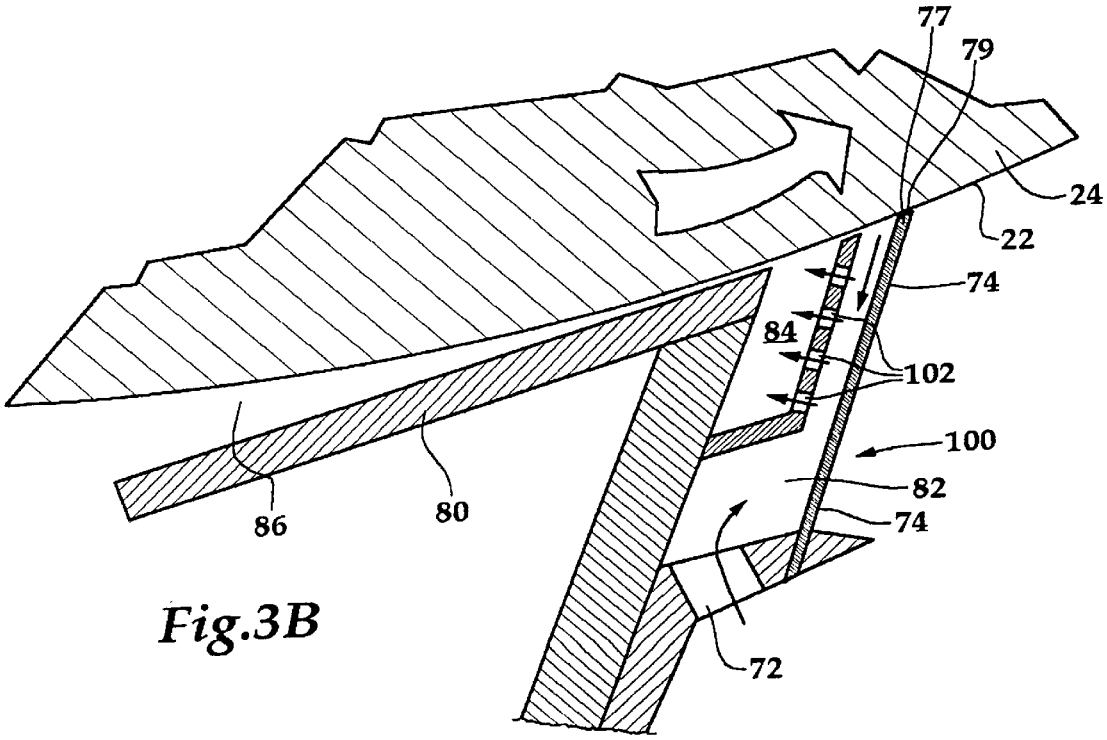
FIG. 3B is a partial cross-section view of a coater head in accordance with a present invention having a number of orifices in a separating blade.
Figure 4B:
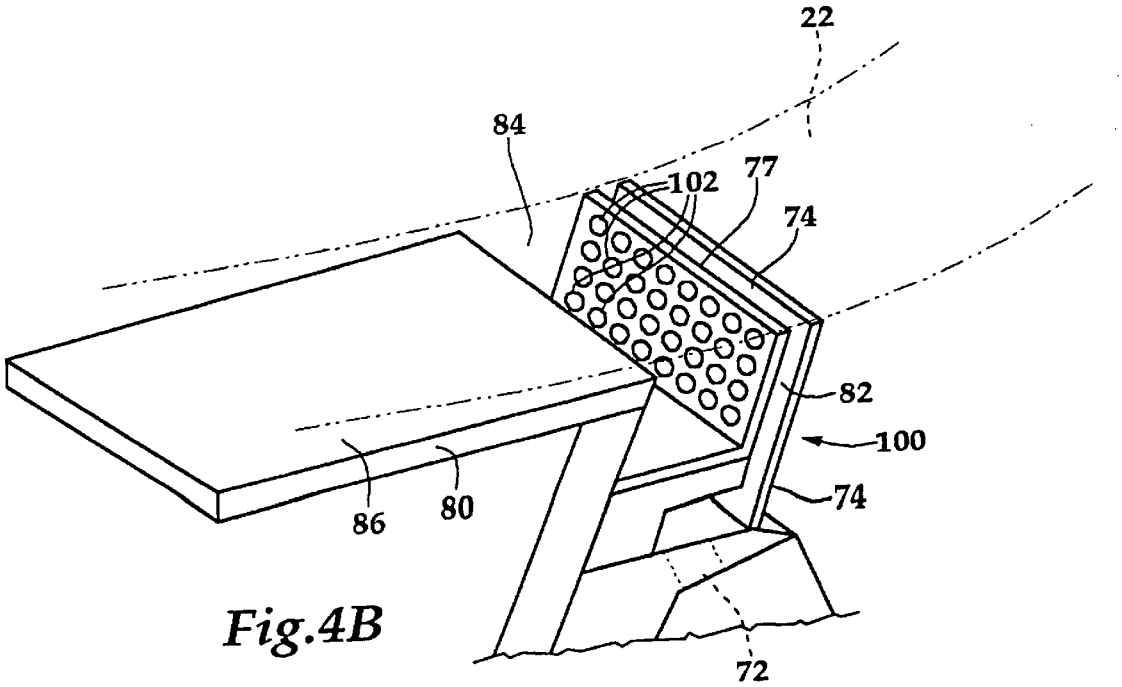
FIG. 4B is a partial perspective view of the coater head illustrated in FIG. 3B.

Another embodiment of a coater head 100 in accordance with present invention is illustrated in FIGS. 3B and 4B and includes all of the same components as the overhead 70 illustrated in FIG. 3A and 4A, except that the slot 78 has been replaced with a plurality of orifices 102 or perforations. These orifices 102 can be used to reduce liquid pressure in the feed/recirculation zone 82 and thereby further eliminate deleterious vortices. Preferably, the separator plate 76 is releasably mounted to the overhead so that orifices 102 or the slot 78 (FIG. 3A) can be used as desired depending upon liquid coating material properties such as viscosity, or as machine speed varies. In this manner, the separator plates are replaceable and adjustable relative to the web 22 and the metering blades so that optimal coating quality is obtained regardless of machine speed or coating rheology which may require different boundary layers or orifices size and location.

The foregoing detailed description of invention is provided for clearness of understanding only and no unnecessary limitations therefrom should be read into the foregoing claims.

What is claimed is:

1. A coater head for coating a traveling web with a film of coating material, the coater head comprising:

an inlet for supplying the coating material;

an internal flow separator having a proximate fixed end and a distal end spaced apart from the traveling web, and at least partially defining a pond;

a metering blade having a proximate fixed end and a distal end, and at least partially defining with the flow separator a feed/recirculation zone, wherein the feed/recirculation zone, the pond and the inlet are in fluid communication with each other such that the coating material supplied from the inlet is received by the pond and feed/recirculation zone, the flow separator is structured and arranged to reduce liquid pressure of the coating material in the feed/recirculation zone; and an outflow baffle having a fixed proximate end extending outwardly there from a distance in a direction opposite the direction of the traveling web to define a free distal end, said outflow baffle defining with the traveling web an outflow zone wherein the outflow zone is in fluid communication with feed/recirculation zone, the pond and inlet such that the coating material contacts the traveling web as the coating material flows through the outflow zone and wherein an extended zone of contact between the coating material and the traveling web is defined by the outflow zone, pond and the feed/recirculation zone and wherein the outflow baffle is structured and arranged relative to the traveling web so as to stabilize a contact line between the coating material and the traveling web.

2. The coater head of claim 1, wherein:

the flow separator defines a plurality of orifices for providing the fluid communication between the pond and the feed/recirculation zone.

3. The coater head of claim 1, wherein:

the flow separator defines a slot for providing the fluid communication between the pond and the feed/recirculation zone.

4. The coater head of claim 1, wherein:

the flow separator is removably mounted on the coater head.

5. The coater head of claim 1, wherein:

the flow separator defines a plurality of orifices in a row parallel to a cross-machine direction.

* * * * *

UNITED STATES PATENT AND TRADEMARK OFFICE

CERTIFICATE OF CORRECTION

PATENT NO. : 6,152,069
DATED : November 28, 2000
INVENTOR(S) : Li et al.

It is certified that error appears in the above-identified patent and that said Letters Patent is hereby corrected as shown below:

Column 2,
Line 67, replace “theological” with -- rheological --

Column 6,
Line 15, replace “there from” with -- therefrom --

Signed and Sealed this

Eighteenth Day of February, 2003

JAMES E. ROGAN
*Director of the United States Patent and Trademark Office*